United States Patent [19]

Carroll

[11] 4,098,343

[45] Jul. 4, 1978

[54] AUTOMATICALLY AND MANUALLY CONTROLLED FIRE EXTINGUISHER

[76] Inventor: John L. Carroll, 2034 SE. Sherman, Portland, Oreg. 97214

[21] Appl. No.: 760,624

[22] Filed: Jan. 19, 1977

[51] Int. Cl.[2] ..... A62C 37/12; A62C 23/02

[52] U.S. Cl. ..... 169/74; 169/42

[58] Field of Search ..... 169/26, 42, 57, 74, 169/75

[56] References Cited

U.S. PATENT DOCUMENTS

| | | | |
|---|---|---|---|
| 1,510,649 | 10/1924 | Boyce | 169/26 |
| 2,070,942 | 2/1937 | Engard et al. | 169/26 |
| 2,526,159 | 10/1950 | Rowley | 169/42 X |
| 2,824,614 | 2/1958 | Bowman | 169/26 |
| 3,010,520 | 11/1961 | Seaberg | 169/75 X |
| 3,719,231 | 3/1973 | Haggard | 169/26 |

*Primary Examiner*—Robert W. Saifer

*Attorney, Agent, or Firm*—Kolisch, Hartwell, Dickinson & Stuart

[57] ABSTRACT

A thermally responsive valve is connected to a fire extinguisher between a pressure gauge and an extinguisher outlet to which such gauge would normally be secured. The valve includes a fitting having a passage extending therethrough so that pressure in the extinguisher may be sensed and displayed by the gauge. Detachably mounted to the fitting is a spray head having a port communicating with the passage, the port being normally sealed by a heat collecting disc. The disc is fused to the spray head by fusible material and when the environment surrounding the extinguisher reaches a predetermined temperature, the fusible material will melt thereby releasing the disc from sealing the port. The extinguisher's pressurized contents are then automatically expelled through the port for extinguishing a fire.

11 Claims, 4 Drawing Figures

AUTOMATICALLY AND MANUALLY CONTROLLED FIRE EXTINGUISHER

BACKGROUND AND SUMMARY OF THE INVENTION

The present invention relates to fire extinguishers, and more particularly to a novel fitting which may be interconnected between a pressure gauge and a port leading to the interior of the fire extinguisher for automatically releasing the extinguisher's contents upon the container-surrounding environment reaching a predetermined temperature.

A typical fire extinguisher includes a cylindrical container for storing fire retardant material under pressure and includes a top portion to which is mounted a manually actuated release mechanism for releasing the extinguisher's contents through a nozzle. The release mechanism generally includes a handle which is pivotally mounted on a nozzle head such that movement of the handle opens a port extending from the container's interior through the spray nozzle to permit the contents to be expelled from such nozzle. The usual fire extinguisher additionally includes a pressure gauge connected to the extinguisher's container so as to display the internal pressure of the container.

It is known to provide so-called fusible link devices on the discharge nozzle of a fire extinguisher to permit release of the extinguisher's contents upon the reaching of a predetermined temperature. For instance, in U.S. Pat. No. 2,824,614 there is disclosed a modified form of a fire extinguisher in which a container includes a dispensing spout having a discharge passage extending therethrough. A plate is secured against the free end of the spout by a fusible agent to close the outer end of the passage. The operation of this fusible agent device is automatic when the device is subjected to enough heat to melt the fusible agent and thereby release the plate therefrom. A knob is also carried by the aforementioned plate to provide a means for facilitating the manual removal of the plate when so desired. However, it is apparent that upon manual removal of such plate, all of the extinguisher's contents would be released. There is no provision in this patent for the selective removal of an extinguisher's contents through manual actuation while still retaining a capability for the extinguisher to automatically release its contents.

Another patent of interest is U.S. Pat. No. 3,273,652 which describes a fire extinguisher including a pressurized chamber provided with a fusible head disposed on a valve through which the container's contents may be released. There is no provision in this patent for manual release of the pressurized contents independently of a release mechanism actuated by the fusible element.

From the above, it can be seen that it would be desirable to modify a fire extinguisher so that such extinguisher could be actuated both manually and by means of a fusible element. However, it is also desirable to have a manually actuated valve operable independently of a release mechanism actuated by the reaching of a predetermined temperature. Accordingly, it is a general object of the present invention to provide a fire extinguisher which includes a spray nozzle for releasing contents upon manual actuation and also includes a thermally responsive spray valve automatically actuable to release the contents upon a predetermined temperature being reached.

To provide such a fire extinguisher, the present invention contemplates the use of a spray valve, or more particularly a valve fitting including a normally sealed spray head which is inserted between a pressure gauge and the coupling by which the pressure gauge is normally secured to the extinguisher's container. The valve fitting of the present invention is constructed with a passage extending therethrough to permit pressure from the extinguisher's container to be sensed by the pressure gauge. Disposed on the fitting is a removable spray head including a port extending from the aforementioned passage. The port is normally sealed by a plate or disc which is fused to the spray head by solder or other material having a predetermined melting point.

Thus, the fire extinguisher including the fitting and spray head of the present invention may be situated in an area subject to the outbreak of a fire and may be actuated upon the environment of the area reaching a predetermined temperature. Such areas might include engine compartments of vehicles, boats, and other powered devices as well as various industrial equipment rooms, warehouses, homes, etc. By placing a fire extinguisher using the spray valve of the present invention such that the spray head is directed toward a region susceptible to fire breakout, upon the reaching of a predetermined temperature, the fusible material will melt, thereby automatically releasing the disc from sealing the port so that the pressurized contents will be expelled through such port. Additionally, before such a predetermined temperature is reached, the fire extinguisher may still be manually actuated without interfering with the thermally responsive spray valve.

Another object of the present invention is to provide a retrofit spray valve which may be readily adapted for connection to existing fire extinguishers without substantial modification to such extinguishers.

Yet another object of the present invention is to provide a thermally responsive spray valve mountable on a fire extinguisher independently from the manually actuated valve such that spray expelled from the thermally responsive valve may be selectively directed.

Still a further object of the present invention is to provide a thermally responsive fire extinguisher which may be reused by merely replacing the thermally responsive spray valve and recharging the extinguisher.

These and other objects and attendant advantages of the present invention will become apparent as further consideration is given to the following detailed description and accompanying drawings.

BRIEF DESCRIPTION OF THE DRAWINGS

Novel features of the fire extinguisher and thermally responsive spray valve of the present invention will be more readily understood from a consideration of the following description taken together with the accompanying drawings, in which a preferred embodiment is illustrated with the various parts thereof identified by suitable reference characters in each of the views, and in which.

DETAILED DESCRIPTION OF THE INVENTION

Figure 1:
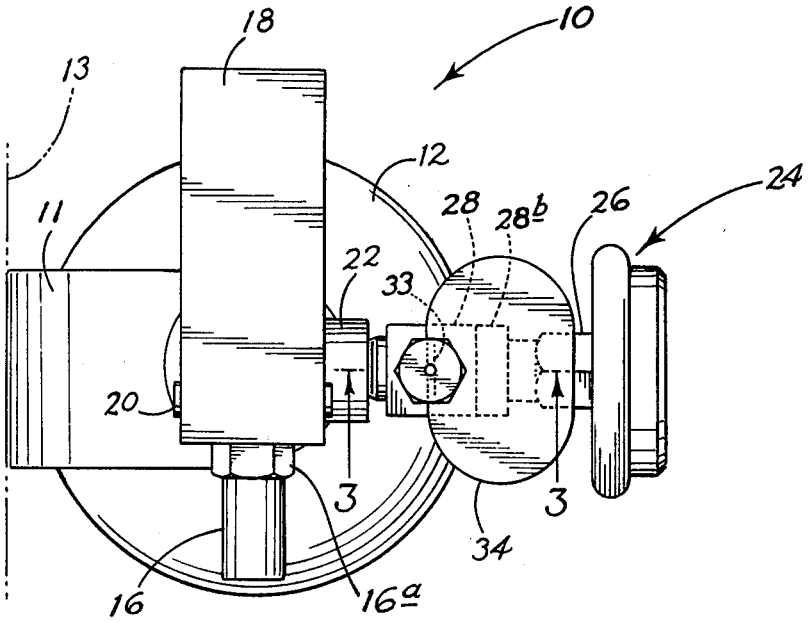
FIG. 1 is a top view of a standard dry chemical fire extinguisher utilizing the thermally responsive spray valve of the present invention interposed between a pressure gauge and an outlet port leading to such gauge.
Figure 2:
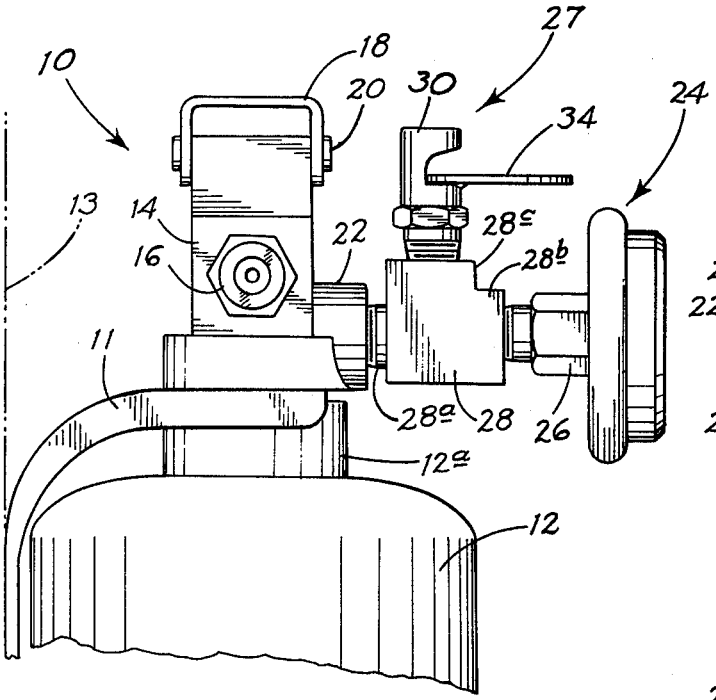
FIG. 2 is a front view looking into the nozzle of the fire extinguisher of FIG. 1, the major portion of the extinguisher's container not being shown.

Turning now to the drawings, and referring initially to FIGS. 1 and 2, there is shown a fire extinguisher generally indicated at 10. The extinguisher 10 includes a cylindrical container 12 for storing fire retardant material under pressure, only a portion of which container is shown in FIG. 2. A spray nozzle housing 14 is secured to an upper extension 12*a* of the container 12 and a first outlet such as nozzle 16 extends outwardly from the housing 14 and communicates via a passage (not shown) with the interior of the container 12.

A handle 18 is pivotally connected by means of a pin 20 to the housing 14. Upon depressing the handle 18, a valve which normally closes the flow of the pressurized contents from the container 12 through the nozzle 16 is opened so that such contents may be expelled through the nozzle 16. The nozzle 16 includes a fastener 16*a* integrally formed thereon so that the nozzle 16 may be connected to the housing 14 and the aforementioned passage. Thus far, the fire extinguisher described is conventional.

A second outlet such as coupling 22 is provided with a threaded aperture which communicates with the interior of the container 12. The passage through which coupling 22 communicates with the interior of the container may be separate from that associated with nozzle 16 and extends downwardly into the container. A pressure gauge, generally designated at 24, includes a fitting 26 which would normally be threadedly secured into the coupling 22. However, in accordance with the principles of the present invention, there is interposed between the pressure gauge 24 and the coupling 22 a thermally responsive spray valve means generally designated at 27. The valve means 27 includes a fitting 28 and a spray head 30 detachably connected thereto.

Figure 3:
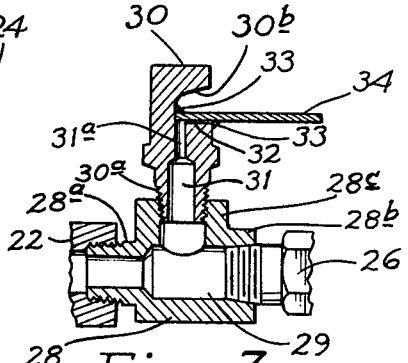
FIG. 3 is a cross-sectional view of the thermally responsive spray valve of the present invention taken along line 3—3 of FIG. 1.

Details of the valve means 27 may be more readily appreciated from a consideration of the cross-sectional view of FIG. 3. As illustrated, the fitting 28 is constructed as a so-called T-fitting having a threaded extension 28*a* adapted to be secured within the threaded coupling 22. Another extension 28*b* includes threads disposed interiorally thereof adapted to receive threads on the fitting 26 of the pressure gauge 24. Extending the length of the fitting 28 is a passage 29 which permits internal pressure of the container 12 to be sensed by the gauge 24.

Extending upwardly from the fitting 28 is an extension or elbow 28*c* which includes threads adapted to detachably receive a threaded portion 30*a* of the spray head 30. Extending through the spray head 30 is another passage or port 31 including a restricted port 31*a*. As shown in FIG. 3, when the spray head 30 is secured to fitting 28, passage 29 and port 31 communicate with each other. The spray head 30 is provided with a surface 32 to which a heat collecting element, or plate member, 34 is attached by fusible material. The member 34 closes off port 31*a* extending from port 31. As shown in FIG. 1, the plate member 34 is somewhat disc-shaped and will readily collect and transmit heat along its surfaces due to its thin profile and material conductivity. The element 34 is supported in cantilever manner on the surface 32 by means of the fusible material, such as solder, which is indicated at 33. It is to be further noted that the spray head 30 includes a deflecting surface 30*b*, the function of which will be more particularly described hereinafter. The mass of solder 33 between element 34 and deflecting plate 30*b* may be a small spot of solder, as illustrated in FIG. 3 or may be a larger mass, substantially filling the gap between element 34 and surface 30*b*. The amount of solder required will depend upon the hardness of the solder used. Solders having a low melting temperature are generally quite soft and a relatively larger amount of such solder will be required to hold element 34 in cantilever fashion within the spray head.

Figure 4:
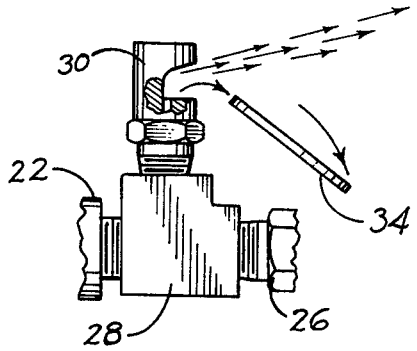
FIG. 4 is a side view of the thermally responsive valve fitting similar to that shown in FIG. 2 partially broken away illustrating the release of extinguishing spray upon the temperature actuated release of a fusible element.

The operation of a known fire extinguisher utilizing the valve means 27 of the present invention will now be described. While the extinguisher 10 is shown supported by means of a bracket 11 to a wall or other surface 13, it must be appreciated that some extinguishers could be situated uprightly without such support in an area in which there is a potential fire hazard. The spray head 30 is directed generally toward an area in which it is anticipated that a fire may break out. The fusible material 33, such as solder connecting the disc 34 to the spray head 30 has a predetermined melting point. If a fire breaks out in the region adjacent to the extinguisher 10, and a predetermined temperature is reached, the fusible material will melt due to the conductive qualities of the heat collecting disc 34. As shown in FIG. 4, the disc 34, being situated in cantilever manner, will be released from obstructing the port 31*a* and fall as shown. Pressure from the container 12 aids in displacing the disc 34 from sealing the port 31*a*. Pressure also urges the retardant material through the passage extending from the container 12 through fitting 22, passage 29, and ports 31, 31*a* for contact against the deflector 30*b* so that spray will be directed outwardly toward the fire or heat source. Thus, the retardant material will be sprayed over a fire automatically.

It will be appreciated that even if the predetermined temperature were not reached, an individual could still direct the nozzle 16 toward the outbreak of fire and manually operate the handle 18 so that retardant material could be directed toward such fire. If the contents of the container 12 were not completely depleted through manual operation, the container 12 could be placed in its previous position and the valve means 27 would still be operable for automatic spraying.

There are several important advantages of the present invention which should be noted. For instance, assuming that a fire extinguisher such as that illustrated at 10 does not include a valve means 27, it can be readily appreciated how easily the valve means 27 of the present invention may be adapted thereto. Assuming that the pressure gauge 24 is initially secured to the fitting 22 and the pressure in the container 12 has been released, the gauge 24 may be unscrewed from attachment and the valve means 27 readily inserted between such gauge 24 and the fitting 22. Thereupon, the spray head 30 may be rotated within the elbow 28*c* so as to face in a preselected direction. Thus, in a matter of a few brief moments, an existing extinguisher 10 may be readily converted so that it will be automatically actuated upon the reaching of a predetermined temperature. In certain applications the passage through which coupling 22 communicates with the interior of the container may require enlargement to permit adequate quantities of the contents to flow therethrough.

Another feature of the present invention is that the disc 24 is connected in a cantilever manner to the spray head 30. Such connection ensures that upon melting of the solder 33, the disc 34 will be released. Such release is fool-proof and trouble-free. After the release of the disc 34 and the expelling of retardant material, the extinguisher is reusable by merely detaching the used spray head 30 and replacing it with a new one having a disc sealing the outlet passage.

It can also be appreciated that the thermally responsive device, or valve means 27 of the present invention requires only a minimal amount of space and extends a gauge 24 only slightly outwardly from its factory-set position on an extinguisher. Thus, no appreciable expansion of space for situating an extinguisher in tight areas such as engine compartments, boat holds, etc. is required.

Because the fitting 28 includes a passage 29 extending therethrough, the pressure gauge 24 will sense and indicate pressure as before.

A further advantage of the present invention resides in the fact that the valve means 27 is simple in construction and can be readily and inexpensively produced and adapted for virtually all manually actuated fire extinguishers having pressure gauges. Furthermore, it is to be noted that the valve means 27 and/or the disc 34 may be coated or plated with different materials (nickel, chromium, etc.) to retard corrosion.

The size and shape of the heat collecting disc 34 may also be changed in order to increase or decrease its surface area. A change in surface area will directly affect the rate at which heat is transferred to the solder. Thus, if it is desired to have the valve means 27 automatically actuated at 293° F. (as for an engine compartment), the type of solder, size of disc 34 and coating material may be suitably selected.

Of primary importance to the present invention is the fact that a fire extinguisher using the valve means 27 is both manually operable and automatically operable. Manual and automatic operation are independent of each other. For instance, the extinguisher could be left in an area where fire danger is anticipated but where an individual is not likely to be present. If the predetermined temperature necessary to actuate the valve means 27 is reached, the automatic discharge will take place. However, until this occurs, the fire extinguisher is still manually operable and portable. It should be apparent that manual operation will always be possible until the disc 34 is separated from sealing the passage 31*a*.

While the invention has been particularly shown and described with reference to the foregoing preferred embodiment, it will be understood by those skilled in the art that other changes in form and detail may be made therein without departing from the spirit and scope of the invention as defined in the appended claims.

It is claimed and desired to secure by Letters Patent:

1. In a fire extinguisher including a container for holding chemical fire retardant material under pressure, a first outlet communicating with the interior of said container including means for selectively delivering the material outwardly from said container and a second independent outlet also communicating with the interior of said container including means for coupling a pressure gauge thereto for indicating container pressure, thermally responsive valve means disposed between said second outlet and said gauge automatically operable at a predetermined temperature for releasing the material from said container.

2. The fire extinguisher of claim 1 wherein said thermally responsive valve means includes a fitting detachably connected to said second outlet and said gauge, said fitting including a passage extending therethrough for permitting pressure to be sensed and indicated by said gauge and further including a port extending outwardly from the passage, which port is normally sealed by an element attached by fusible material having a predetermined melting point to the fitting over said port, said element being releasable from said port for permitting escape of fire retardant material therethrough when said predetermined temperature is reached and said fusible material is melted.

3. The fire extinguisher of claim 2 wherein a spray head is connected to said fitting, said spray head having an internal bore defining said port, said element being a plate member.

4. The fire extinguisher of claim 3 wherein said plate member is arranged on said spray head such that it will be forced from said port by the pressure within said container and fall from sealing said port when said fusible material melts upon said predetermined temperature being reached.

5. The fire extinguisher of claim 4 wherein said spray head includes a deflecting surface for directing the contents expelled from said port.

6. The fire extinguisher of claim 4 wherein said spray head is detachably connected to said fitting.

7. For use with a fire extinguisher having a container for holding chemical fire retardant material under pressure, said container having a first outlet communicating with the interior of said container including means manually operable for selectively delivering said material and a second outlet also communicating with the container's interior having means associated therewith for coupling a pressure indicating gauge to said container, a thermally responsive valve means comprising:

a fitting adapted to be detachably connected to said second outlet and said gauge, said fitting also including a passage extending therethrough for permitting the internal pressure of the container to be indicated by said gauge;

a spray head secured to said fitting, said spray head having a port communicating with said passage; and heat collecting means fused to said spray head by fusible material for preventing escape of said container's material through said port, said means being automatically releasable from said spray head to permit escape of the container's material when a predetermined container surrounding temperature is reached and said fusible material is melted.

8. The valve means of claim 7 wherein said spray head is detachably connected to said fitting.

9. The valve means of claim 7 wherein said heat collecting means includes a disc-like member, which when fused to said head, is cantilever supported thereon.

10. A fire extinguisher having a container for holding chemical fire retardant material under pressure, said extinguisher including a first outlet having a valve means manually operable to selectively expel the material under pressure and a second outlet to which a thermally responsive valve means is connected, said first and second outlets being disposed adjacent one another, said thermally responsive valve means including a spray head having a port which is normally sealed by an element fused directly to said spray head, said thermally responsive valve means being operable independently from said manually operable valve means for automatically permitting release of said material from the container when the environment surrounding the container reaches a predetermined temperature.

11. The fire extinguisher of claim 10 wherein said element, when fused to said head, is cantilever supported thereon, and wherein said spray head includes a deflecting surface overhanging the fused portion of said element.

* * * * *